US008772216B2

(12) United States Patent
Volont et al.

(10) Patent No.: US 8,772,216 B2
(45) Date of Patent: Jul. 8, 2014

(54) LOW VOC HARD SURFACE CLEANING COMPOSITION COMPRISING A GLYCOL ETHER SOLVENT

(71) Applicant: The Procter & Gamble Company, Cincinnati, OH (US)

(72) Inventors: Cedric Joseph Volont, Laken (BE); William Tucker Campbell, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 13/915,760

(22) Filed: Jun. 12, 2013

(65) Prior Publication Data

US 2013/0345110 A1 Dec. 26, 2013

Related U.S. Application Data

(60) Provisional application No. 61/663,005, filed on Jun. 22, 2012.

(51) Int. Cl.

| | |
|---|---|
| ***C11D 3/44*** | (2006.01) |
| ***C11D 1/72*** | (2006.01) |
| ***C11D 1/92*** | (2006.01) |

(52) U.S. Cl.

USPC ..... 510/237; 510/235; 510/245; 510/254; 510/356; 510/362; 510/365; 510/421; 510/432; 510/490

(58) Field of Classification Search

USPC ..... 510/235, 237, 245, 254, 356, 362, 365, 510/432, 421, 490

See application file for complete search history.

(56) References Cited

U.S. PATENT DOCUMENTS

| | | | | |
|---|---|---|---|---|
| 6,323,171 | B1 * | 11/2001 | Fonsny et al. | 510/384 |
| 7,314,852 | B1 * | 1/2008 | Cummings et al. | 510/163 |
| 2008/0305978 | A1 * | 12/2008 | Wietfeldt et al. | 510/109 |
| 2009/0197793 | A1 * | 8/2009 | Inoue et al. | 510/433 |
| 2012/0128614 | A1 * | 5/2012 | Rieth et al. | 424/70.1 |

FOREIGN PATENT DOCUMENTS

| | | | |
|---|---|---|---|
| CA | 2 816 718 | A1 | 5/2012 |
| DE | 199 08 564 | A1 | 9/1999 |
| WO | WO 2005/100522 | A1 | 10/2005 |

OTHER PUBLICATIONS

International Search Report; International Application No. PCT/US2013/044520; date of mailing Sep. 13, 2013; 11 pages.

* cited by examiner

*Primary Examiner* — Charles Boyer

(74) *Attorney, Agent, or Firm* — John T. Dipre; Steven W. Miller

(57) ABSTRACT

The present invention relates to a low VOC hard surface cleaning composition comprising a surfactant, a glycol ether organic solvent, an aminoalcohol and fragrance, having a pH from 10.0 to 12.0. The present invention further encompasses a process to prepare a low VOC hard surface cleaning composition. Furthermore, the present invention encompasses a process of cleaning a hard surface with a low VOC hard surface cleaning composition.

16 Claims, No Drawings

LOW VOC HARD SURFACE CLEANING COMPOSITION COMPRISING A GLYCOL ETHER SOLVENT

FIELD OF THE INVENTION

The present invention relates to a low volatile organic compounds (VOC) hard surface cleaning composition. The low VOC hard surface cleaning composition of the present invention was found to exhibit cleaning and shine performance benefits upon cleaning of a hard surface.

BACKGROUND OF THE INVENTION

Liquid compositions comprising high solvent content for cleaning hard surfaces are well known in the art. Generally these high solvent content cleaning compositions provide good/excellent cleaning. Low VOC (volatile organic compound) hard surface cleaning compositions are desirable due to environmental considerations. Low VOC hard surface cleaning compositions are produced by removing the high vapour pressure organic solvents from the cleaning compositions, however, removal of these solvents results a loss of cleaning and shine performance.

Often, low VOC hard surface cleaning compositions are providing inferior cleaning and are difficult to formulate to be phase stable. Additionally the shine benefit of low VOC hard surface cleaning compositions is often inferior due the faster evaporation rate of VOC content. Furthermore, low VOC hard surface cleaning compositions have been difficult to formulate to form of clear, phase stable and aesthetically pleasing solution. Finally, Low VOC compositions have been more expensive to produce in comparison to their VOC alternatives.

Thus, the objective of the present invention is to provide a phase stable low VOC hard surface cleaning composition exhibiting excellent cleaning performance benefit upon contact of low VOC hard surface cleaning compositions on soil while providing an adequate shine benefit. An additional objective of the present invention is to be able to formulate higher level and/or stronger perfumes to increase the longevity of the perfume.

It has now been found that these objectives can be met by the low VOC hard surface cleaning compositions according to the present invention.

An advantage of the present invention is that the low VOC hard surface cleaning compositions may be used to clean hard surfaces made of a variety of materials like glazed and non-glazed ceramic tiles, enamel, stainless steel, Inox®, Formica®, vinyl, no-wax vinyl, linoleum, melamine, glass, plastics and plastified wood.

SUMMARY OF THE INVENTION

The present invention relates to a low VOC hard surface cleaning composition comprising a) from 0.30 to 1.0% by weight of the composition of a surfactant or mixture thereof selected from the group consisting of sulfobetaines and non-ionic surfactants; b) from 1.25 to 2.5% by weight of the composition of a glycol ether organic solvent or mixture thereof selected from the group consisting of butyl carbitol, hexylcellosolve and phenoxyethanol and mixtures thereof; c) from 0.1 to 0.5% by weight of the composition of an aminoalcohol or mixture thereof; and d) from 0.075 to 0.3% by weight of the composition of a perfume or mixture thereof; and wherein said composition has pH from 10.0 to 12.0.

The present invention further encompasses a process to prepare a low VOC hard surface cleaning composition.

The present invention further encompasses a process of cleaning a hard surface with a low VOC hard surface cleaning composition.

DETAILED DESCRIPTION OF THE INVENTION

The Low VOC Hard Surface Cleaning Composition.

The compositions according to the present invention are designed as cleaners for a variety of household hard surfaces.

By "household hard surface", it is meant herein any kind of surface typically found in and around houses like kitchens, bathrooms, e.g., floors, walls, tiles, windows, cupboards, sinks, showers, shower plastified curtains, wash basins, WCs, fixtures and fittings and the like made of different materials like ceramic, porcelain, vinyl, no-wax vinyl, linoleum, melamine, glass, Inox®, Formica®, Corian®, stainless steel, chrome, any plastics, plastified wood, metal or any painted or varnished or sealed surface and the like. Household hard surfaces also include household appliances including, but not limited to refrigerators, freezers, washing machines, automatic dryers, ovens, microwave ovens, dishwashers and so on. Such hard surfaces may be found both in private households as well as in commercial, institutional and industrial environments.

By "VOC", it is meant herein volatile organic compounds that have a high vapor pressure at ordinary, room-temperature conditions. Their high vapor pressure results from a low boiling point, which causes large numbers of molecules to evaporate or sublimate from the liquid or solid form of the compound and enter the surrounding air.

By "Low VOC", it is meant herein volatile organic compounds or mixture of organic compounds that contain at least one carbon atom and meets one of the following: (a) have a vapour pressure less than 0.1 mm Hg at 20° C. as determined by ARB method 310; (b) is a chemical compound with more than 12 carbon atoms or a chemical compound mixture comprised solely of compounds with more than 12 carbon atoms and the vapour pressure and boiling point are unknown or (c) is chemical compound with a boiling point greater than 216° C. as determined by ARB method 310.

By "Low VOC hard surface cleaning composition", it is meant herein a finished product having low VOC content—maximum of 0.5% by weight of the composition of VOCs, however, it is noted that fragrance is exempted from this value up to 2% by the weight of the finished product.

By "phase stable", it is meant herein a clear and transparent finished product showing no phase separation, haze or precipitation.

In a preferred embodiment herein, the low VOC hard surface cleaning compositions herein are aqueous compositions. Therefore, they may comprise from 90% to 98.5% by weight of the total composition of water, preferably from 93% to 98% and more preferably from 96% to 98%.

The low VOC hard surface cleaning compositions according to the present invention are aqueous liquid compositions as opposed to solids or gases having water like viscosity.

The pH of the low VOC hard surface cleaning compositions herein is from 10.0 to 12.0, preferably from 10.5 to 11.8, more preferably from 10.5 to 11.4, even more preferably from 10.9 to 11.1 and most preferably pH is 11. Indeed, it has been surprisingly found that the cleaning performance is further improved at these preferred alkaline pH ranges. Accordingly, the compositions herein may further comprise an acid or base to adjust pH as appropriate.

A suitable acid for use herein is an organic and/or an inorganic acid. A preferred organic acid for use herein has a pka of less than 6. A suitable organic acid is selected from the group consisting of citric acid, lactic acid, glycolic acid, succinic acid, glutaric acid, tartaric acid and adipic acid and mixtures thereof. A mixture of said acids may be commercially available from BASF under the trade name Sokalan® DCS. A suitable inorganic acid is selected from the group consisting hydrochloric acid, sulphuric acid, phosphoric acid and mixtures thereof.

A typical level of such an acid, when present, is of from 0.01% to 5.0% by weight of the total composition, preferably from 0.01% to 3.0% and more preferably from 0.02% to 1.5%.

A suitable base to be used herein is an organic and/or inorganic base. Suitable bases for use herein are the caustic alkalis, such as sodium hydroxide, potassium hydroxide and/or lithium hydroxide, and/or the alkali metal oxides such, as sodium and/or potassium oxide or mixtures thereof. A preferred base is a caustic alkali, more preferably sodium hydroxide and/or potassium hydroxide.

Other suitable bases include ammonia and alkanolamines (as e.g. monoethanolamine). Carbonate salts are not preferred, as they impact negatively on shine.

Typical levels of such bases, when present, are of from 0.01% to 5.0% by weight of the total composition, preferably from 0.05% to 3.0% and more preferably from 0.1% to 2.0%.

Solvent

The low VOC hard surface cleaning composition of the present invention comprises a solvent or a mixture thereof. The solvent can be a combination of conventional solvents as known for use in cleaning compositions, which assists the cleaning. The suitable solvent is selected from the group consisting of VOC solvent, low VOC solvent or mixture thereof, however, the total quantity of VOC solvent does not exceed 0.5% of the weight of the final composition. Preferably the solvent is a low VOC solvent.

Suitable organic solvents used herein are low VOC glycol ether based solvent. The glycol ether based solvents have an impact on perfume emulsification and long term stability of the low VOC hard surface cleaning composition. Additionally, low VOC glycol ether based solvents have an impact on shine performance and antimicrobial (AB) efficacy.

Suitable organic solvents used in the present invention are low VOC glycol ether based solvents selected from the group consisting of butyl carbitol, hexylcellosolve and phenoxyethanol and mixture thereof.

Glycol ether based solvents are used in amount from 1.25 to 2.5% by weight of the composition, preferably from 1.25 to 2.25%, and most preferably from 1.5 to 2.0%.

Aminoalcohol Solvent

The low VOC hard surface cleaning composition of the present invention comprises an aminoalcohol or a mixture thereof.

Suitable aminoalcohols used herein are selected from the group consisting of monoethanolamine, monoisopropanolamine and mixtures thereof, most preferably said aminoalcohol is monoethanol amine.

Suitable aminoalcohols used herein are all considered to be VOC solvents, and therefore, maximum quantity of aminoalcohol or a mixture thereof is 0.5% by weight of the final composition.

Aminoalcohols are used in amount from 0.25 to 0.5% by weight of composition, more preferably from 0.35 to 0.5%, and most preferably 0.5%.

Surfactants

The low VOC hard surface cleaning composition according to present invention comprises a surfactant or mixture thereof.

The selected surfactant or mixture thereof has an impact on perfume solubility by emulsifying the perfume into water. This effect also leads to improved phase stability of the low VOC hard surface cleaning composition according to present invention.

The surfactant is selected from the group consisting of sulfobetaines, non-ionic surfactants and mixtures thereof.

Suitable sulfobetaine surfactants according to present invention provide good perfume emulsification, while being at the same time relatively shine neutral.

Particularly preferred sulfobetaine in the present invention is cocamidopropyl hydroxysultaine. This particular sulfobetaine surfactant provides excellent perfume emulsification, while being shine neutral.

The nonionic surfactant according to the present invention can be an alkoxylated nonionic surfactant. Suitable alkoxylated nonionic surfactants herein to be mentioned are primarily $C_{13}$-$C_{15}$ alcohol polyglycol ether i.e. ethoxylated alcohols having 13 to 15 carbon atoms in the alkyl moiety and 4 to 30 ethylene oxide (EO) units. When referred to for example $C_{9-14}$ it is meant average carbons and alternative reference to for example EO8 is meant average ethylene oxide units. Most preferred are ethoxylated alcohols having 13 to 15 carbon atoms in the alkyl moiety and 21 to 30 ethylene oxide (EO) units.

Suitable non-ionic surfactants according to present inventions provide good composition stability and ingredient compatibility.

Alternatively, the non-ionic surfactant according to the present invention can be an alkyl polyglycoside.

Suitable alkyl polyglucosides for use herein are generally disclosed in U.S. Pat. No. 4,565,647. Suitable polyglucosides have a hydrophobic group containing from 6 to 30 carbon atoms, preferably from 8 to 16 carbon atoms and polysaccharide, e.g., a polyglycoside, hydrophilic group containing from 1.3 to 10 saccharide units, preferably from 1.5 to 3, most preferably from 1.3 to 2.5 saccharide units. Any reducing saccharide containing 5 or 6 carbon atoms can be used, e.g., glucose, galactose, and galactosyl moieties can be substituted for the glucosyl moieties. Optionally the hydrophobic group is attached at the 2-, 3-, 4-, etc. positions thus giving a glucose or galactose as opposed to a glucoside or galactoside. The intersaccharide bonds can be, e.g., between the one position of the additional saccharide units and the 2-, 3-, 4-, and/or 6-positions of the preceding saccharide units. The glycosyl is most preferably derived from glucose.

Surfactants are present in amount from 0.30 to 1.0% by weight of the composition of surfactant, preferably from 0.3 to 0.65% and most preferably from 0.35 to 0.5%.

Perfumes

The low VOC hard surface cleaning composition according to present invention comprises a perfume or mixture thereof.

Generally, a perfume is a mixture of aromatic natural oils and aromatic chemicals, which taken together, form a complex scent that delivers a number of benefits. In the case of spray cleaners, these benefits include, but are not limited to: coverage of product base odor, scenting the product itself, delivery of scent to the air when spraying the product on a surface, delivery of scent to the air while wiping the product on the surface, and lingering scent radiating from the surface into the air after cleaning.

Suitable perfumes for use herein include materials which provide an olfactory aesthetic benefit and/or cover any "chemical" odour that the product may have.

Suitable perfumes for use herein include materials which are fully solubilised into the composition providing aesthetically pleasing clear phase stable composition.

Suitable perfumes/perfume ingredients used herein can be natural oil and synthetic perfumes.

Suitable perfumes for use herein include perfumes comprising one or more perfume ingredients, some examples of typical perfume ingredients are shown in table 1

Suitable perfumes herein can be formulated at higher level and/or stronger perfumes to increase the longevity of the perfume. The appropriate hydrophilic-lipophilic balance (HLB) of the surfactant/solvent system according to present invention allows emulsification of higher perfume levels, and therefore, providing a longer lasting scent upon product usage.

The perfumes, as disclosed herein, can be formulated into the low VOC hard surface cleaning compositions in order to provide clear phase stable composition.

TABLE 1

| Examples of perfume ingredients | | |
|---|---|---|
| alloocimene | dimethyl benzyl carbinyl acetate | linalyl formate |
| 2-methoxy naphthalene | dimethyl octanol | menthone |
| 4-terpinenol | diphenyl methane | menthyl acetate |
| allyl caproate | diphenyl oxide | methyl acetophenone |
| allyl cyclohexane propionate | d-limonene | methyl amyl ketone |
| allyl heptoate | dodecalactone | methyl anthranilate |
| alpha-ionone | ethyl acetate | methyl benzoate |
| alpha-irone | ethyl acetoacetate | methylbenzyl acetate |
| alpha-iso methyl ionone | ethyl amyl ketone | methyl chavicol |
| alpha-pinene | ethyl benzoate | methyl cinnamate |
| alpha-santalol | tthyl butyrate | methyl dihydrojasmonate |
| alpha-terpinene | ethyl hexyl ketone | methyl eugenol |
| alpha-terpineol | ethyl methylphenylglycidate | methyl heptenone |
| ambrettolide | ethyl phenylacetate | methyl heptine carbonate |
| amyl acetate 142 | ethyl undecylenate | methyl heptyl ketone |
| amyl benzoate | ethylene brassylate | methyl hexyl ketone |
| amyl cinnamate | eucalyptol | methyl nonyl acetaldehyde |
| amyl cinnamic aldehyde | eugenol | methyl octyl acetaldehyde |
| amyl cinnamic aldehyde dimethyl acetal | exaltolide | methyl phenyl carbinyl acetate |
| amyl propionate | fenchyl acetate | methyl salicylate |
| anethol | fenchyl alcohol | methyl-N-methyl anthranilate |
| anisic aldehyde | flor acetate (tricyclodecenyl acetate) | myrcene |
| anisole | frutene (tricyclodecenyl propionate) | myristicin |
| aurantiol | galaxolide | neral |
| benzaldehyde | gamma methyl ionone | nerol |
| benzophenone | gamma-ionone | neral acetate |
| benzyl acetate | gamma-n-methyl ionone | nonyl acetate |
| benzyl acetone | gamma-nonalactone | nonyl aldehyde |
| benzyl alcohol | gamma-terpinene | octalactone |
| benzyl butyrate | gamma-undecalactone | octyl alcohol (2-octanol) |
| benzyl formate | geraniol | octyl aldehyde |
| benzyl isovalerate | geranyl acetate | orange terpenes (d-limonene) |
| benzyl propionate | geranyl anthranilate | 10-oxahexadecanolide |
| benzyl salicylate | geranyl formate | 11-oxahexadecanolide |
| beta gamma hexenol | geranyl isobutyrate | para-cresol |
| beta-caryophyllene | geranyl nitrile | para-cresyl methyl ether |
| beta-ionone | hexadecanolide | para-cymene |
| beta-methyl naphthyl ketone | hexenol | para-osopropyl phenylacetaldehyde |
| beta-pinene | hexenyl acetate | para-methoxyacetophenone |
| cadinene | hexenyl isobutyrate | para-methylacetophenone |
| camphene | hexenyl salicylate | patchouli alcohol |
| camphor gum | hexyl acetate | phantolide |
| carvacrol | hexyl cinnamic aldehyde | phenoxyethanol |
| cedrol | hexyl formate | phenylacetaldehyde |
| cedryl acetate | hexyl neopentanoate | phenyl ethyl acetate |
| cinnamic alcohol | hexyl salicylate | phenyl ethyl alcohol |
| cinnamyl cinnamate | hexyl tiglate | phenylethyl benzoate |
| cinnamyl formate | hydratropic alcohol | phenylethyldimethyl carbinol |
| cis-3-hexenyl acetate | hydroxycitronellal | phenyl heptanol |
| cis-3-hexenyl tiglate | indole | phenyl hexanol |
| cis-jasmone | isoamyl alcohol | phenylethylphenylacetate |
| citral (neral) | iso-amyl salicylate | prenyl acetate |
| citronellol | isobornyl acetate | propyl butyrate |
| citronellyl acetate | isobutyl benzoate | pulegone |
| citronellyl isobutyrate | isobutyl quinoline | rose oxide |
| citronellyl nitrile | isoeugenol | safrole |
| citronellyl propionate | isomenthol | terpinolene |
| coumarin | isomenthone | terpinyl acetate |

TABLE 1-continued

| Examples of perfume ingredients | | |
|---|---|---|
| cuminic alcohol | isononyl acetate | tetrahydro linalool |
| cuminic aldehyde | isononyl alcohol | tetrahydro myrcenol |
| cyclal C | isopulegol | thibetolide |
| cyclamen aldehyde | isopulegyl acetate | tonalid |
| cyclohexyl ethyl acetate | isoquinoline | undecenal |
| cyclohexyl salicylate | laevo-carveol | vanillin |
| d-carvone | laevo-carvone | veratrol |
| decyl aldehyde | lauric aldehyde (dodecanal) | verdox |
| delta-nonalactone | ligustral | vertenex |
| delta-undecalactone | lilial (p-t-bucinal) | vetiveryl acetate |
| dihydro isojasmonate | linalool | viridine |
| dihydro myrcenol | linalool oxide | vara-vara |
| dihydromyrcenyl acetate | linalyl acetate | Iso E super |
| dimethyl benzyl carbinol | linalyl benzoate | methyl cedrylone |
| Orange oil | Bergamot oil | Mandarin oil |
| Lemon oil | lavander | Lavandin grosso oil |
| Lavender spike oil | Clove oil | Rosemary oil |
| *Eucalyptus* oil | | |

Perfumes are present in amount from 0.075% to 0.3% by weight of the composition of perfume, preferably from 0.08 to 0.27% and most preferably from 0.1 to 0.25%.

Chelating Agents

The low VOC hard surface cleaning composition according to the present invention may further comprise chelating agent or mixture thereof. Suitable chelating agents provide colour stability for the low VOC hard surface cleaning compositions.

Chelating agent can be incorporated in the compositions herein in amounts ranging from 0.05% to 0.25% by weight of the total composition, preferably from 0.075% to 0.15%, more preferably from 0.09% to 0.11% and most preferably 0.1%.

Suitable chelating agents used herein are phosphonate chelating agents, biodegradable chelating agents, aminocarboxylate, and carboxylate chelants.

Suitable phosphonate chelating agents for use herein may include ethylenediaminetetra methylene phosphonates, and diethylenetriaminepentamethylene phosphonates (DTPMP). The phosphonate compounds may be present either in their acid form or as salts of different cations on some or all of their acid functionalities. Preferred phosphonate chelating agent to be used herein is diethylenetriaminepentamethylene phosphonate (DTPMP). Such phosphonate chelating agents are commercially available from Monsanto under the trade name DEQUEST®.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename ssEDDS® from Palmer Research Laboratories.

Most preferred biodegradable chelating agent is L-glutamic acid N,N-diacetic acid (GLDA) commercially available under tradename Dissolvine 47S from Akzo Nobel.

Suitable amino carboxylates for use herein include ethylenediamine tetraacetates, diethylenetriamine pentaacetates, diethylenetriamine pentaacetate (DTPA), N-hydroxyethylethylenediamine triacetates, nitrilotriacetates, ethylenediamine tetrapropionates, triethylenetetraamine hexaacetates, ethanoldiglycines, and methylglycine diaceticacid (MGDA), both in their acid form, or in their alkali metal, ammonium, and substituted ammonium salt forms. Particularly suitable amino carboxylate to be used herein is propylene diamine tetracetic acid (PDTA) which is, for instance, commercially available from BASF under the trade name Trilon FS® and methylglycine diaceticacid (MGDA). Most preferred aminocarboxylate used herein is diethylenetriamine pentaacetate (DTPA) from BASF.

Further carboxylate chelating agents for use herein include salicylic acid, aspartic acid, glutamic acid, glycine, malonic acid or mixtures thereof.

Antibacterial Agent

The low VOC hard surface cleaning composition according to the present invention may further comprises antimicrobial agent or mixtures thereof.

A low VOC hard surface composition may further comprise from 0.01 to 0.15% by weight of the composition of an antibacterial agent, wherein said antibacterial agent is used, the surfactant is ethoxylated alcohol.

When the antibacterial agent is used, then the surfactant is non-ionic surfactant, to guarantee the product stability and ingredient compatibility.

Suitable antimicrobial agents used herein the present invention are selected from the group consisting of blend (1:1) of alkyl dimethyl benzyl ammonium chloride and alkyl dimethyl ethylbenzyl ammonium chloride; didecyl dimethyl ammonium chloride, and mixtures thereof, most preferably said antimicrobial agent is blend (1:1) of alkyl dimethyl benzyl ammonium chloride and alkyl dimethyl ethylbenzyl ammonium chloride.

Low VOC hard surface cleaning compositions according to present invention may comprise, from 0.05 to 0.15% by weight of composition of said antimicrobial agent, preferably from 0.05 to 0.15%, more preferably from 0.08 to 0.11% and most preferably 0.1%.

Optional Ingredients:

The low VOC hard surface cleaning compositions according to the present invention may comprise a variety of other optional ingredients depending on the technical benefit aimed for and the surface treated.

Suitable optional ingredients for use herein include builders, polymers, buffers, bactericides, colorants, stabilisers, radical scavengers, abrasives, hydrotropes, soil suspenders, brighteners, dispersants, preservatives, pigments, silicones and/or dyes.

Hydrotropes

Particularly preferred optional ingredient is hydrotrope, due its ability to stabilise the low VOC hard surface cleaning composition at low temperatures.

Suitable hydrotropes for use herein include sodium cumene sulphonate (NaCS) and sodium xylene sulfonate (NaXS).

Hydrotropes may be incorporated in the compositions herein in amounts ranging from 0.001% to 0.3% by weight of the total composition.

Abrasives

Particularly preferred optional ingredient is abrasives, due its ability to increase the cleaning performance. Suitable abrasives used herein are hard enough to improve cleaning performance, whilst soft enough to provide adequate surface safety. Suitable abrasive used herein are selected from the group consisting of synthetic abrasives, biodegradable synthetic abrasives and natural abrasives and mixtures thereof.

Suitable synthetic abrasives can be derived by grinding melamine foam, polyurethane foam, and foam comprising divinyl benzene cross-linked styrene polymer and mixtures thereof.

Suitable synthetic biodegradable abrasives can be derived by grinding polyurethane foam, foam comprising polylactic acid, foam comprising polyhydroxy-alkanoates and foam comprising aliphatic polyester formed from aliphatic dicarboxylic acid monomers and alkanediol monomers.

Suitable natural abrasives can be derived by grinding nut shell or other plant parts such as stems, roots, leaves, seeds and mixtures thereof. When nut shells are used to produce the abrasives, the nut shell is selected from the group consisting of walnut shell, almond shell, pistachio shell and mixtures thereof. When other plant parts are used to produce the abrasives, they are preferably derived from rice, corn cob, palm biomass, bamboo, kenaf, apple seeds, apricot stone, olive stone, vegetable ivory and mixtures thereof.

Abrasives may be incorporated in the compositions herein in amounts ranging from 0.1% to 3.0% by weight of the total composition.

Compaction

The low VOC hard surface cleaning composition according to the present invention can also be prepared in a compacted form. By "compaction" is meant herein concentrated formula, wherein the concentration of ingredients is increased by reducing the water level. The low VOC hard surface cleaning compositions according to the present invention are phase stable up till 15 fold compaction. In one embodiment preferred compaction is between 10 to 15 fold compaction. Yet, in another embodiment compaction is between 2 to 8 fold compaction, more preferably between 3 to 7 fold compaction.

Packaging Form of the Compositions

The low VOC hard surface cleaning compositions herein may be packaged in a variety of suitable detergent packaging known to those skilled in the art. Preferably, the liquid compositions are packaged in conventional detergent plastic bottles.

In one embodiment the compositions herein may be packaged in manually or electrically operated spray dispensing containers, which are usually made of synthetic organic polymeric plastic materials. Accordingly, the present invention also encompasses low VOC hard surface cleaning compositions of the invention packaged in a spray dispenser, preferably in a trigger spray dispenser or pump spray dispenser.

In yet another embodiment, a thickened low VOC hard surface cleaning composition according to the present invention is loaded on a cleaning substrate, whereas the substrate is a paper or nonwoven towel or wipe or a sponge.

The Process of Preparing the Low VOC Hard Surface Cleaning Composition

The low VOC hard surface composition of the present invention is prepared by mixing the ingredients together. However, the addition of the perfume into composition is important for the perfume solubilisation.

In order to formulate phase stable low VOC hard surface composition, process of preparing composition comprises steps of:

i) Preparing a perfume premix by adding a perfume, a solvent and a surfactant together and stirring;
ii) Preparing an aqueous premix by adding remaining ingredients into water and stirring;
iii) Adding the perfume premix from the step i) into the aqueous premix from the step ii) and stirring.

Complete perfume emulsification is achieved by preparing perfume premix including a perfume, a solvent and a surfactant and stirring it well. This leads to complete perfume solubilisation when the perfume premix is mixed with the aqueous premix, which equals to a phase stable low VOC hard surface composition.

The Process of Cleaning a Surface

The present invention encompasses a process of cleaning a surface with a low VOC hard surface cleaning composition according to the present invention. Suitable surfaces herein are described herein above under the heading "The low VOC hard surface cleaning composition".

In a preferred embodiment said surface is contacted with the composition according to the present invention, preferably wherein said composition is applied onto said surface.

In another preferred embodiment, the process herein comprises the steps of dispensing (e.g., by spraying, pouring, squeezing) the low VOC hard surface cleaning composition according to the present invention from a container containing said liquid composition and thereafter cleaning said surface.

A preferred embodiment of the present invention provides that the low VOC hard surface cleaning composition is applied onto the surface to be treated.

By "in its neat form", it is to be understood that the low VOC hard surface cleaning composition is applied directly onto the surface to be treated without undergoing any dilution, i.e., the liquid composition herein is applied onto the hard surface as described herein.

In a preferred embodiment of the present invention said hard surface is inclined or vertical. Inclined or vertical hard surfaces include minors, lavatory pans, urinals, drains, waste pipes and the like.

In another embodiment of the present invention said low VOC hard surface cleaning composition is poured onto said hard surface. More preferably, said low VOC hard surface cleaning composition is poured in its neat form onto said hard surface.

In another preferred embodiment of the present invention said process of cleaning a hard surface includes the steps of applying, preferably spraying, said low VOC hard surface cleaning composition onto said hard surface, leaving said liquid composition to act onto said surface for a period of time to allow said composition to act, preferably without applying mechanical action, and optionally removing said low VOC hard surface cleaning composition, preferably removing said low VOC hard surface cleaning composition by rinsing said hard surface with water and/or wiping said hard surface with an appropriate instrument, e.g., a sponge, a paper or cloth towel and the like.

The hard surfaces to be treated may be soiled with a variety of soils, e.g., greasy soils (e.g., greasy soap scum, body grease, kitchen grease or burnt/sticky food residues typically found in a kitchen and the like), particulate greasy soils.

Neat Cleaning Performance Test Method

The cleaning performance may be evaluated by the following test methods:

On Horizontal Surfaces:

Kitchen or bath tiles (ceramic, enamel or stainless steel) are prepared by applying to them a representative grease- or grease/particulate-artificial soil followed by ageing (2 hours at 135° C.) of the soiled tiles and cooling and/or drying for 20 hours at 20° C. The test composition is evaluated by applying a small amount of product (e.g., 5 to 10 ml) directly to the soiled tiles and letting the test composition to act for some time (e.g., up to 1 minute). The test composition is afterwards removed from said tile either by wiping the composition of or rinsing the tile. The cleaning performance is evaluated by measuring the number of cycles needed to get a clean surface versus a reference. The result, i.e., the number of cycles, of the test composition is compared against the result of a reference composition. Alternatively, the cleaning performance may be evaluated either by visually grading the tiles or by using a Colorimeter® Gloss meter. The visual grading may be performed by a group of expert panellists using panel score units (PSU). To assess the cleaning performance benefits of a given composition a PSU-scale ranging from 0, meaning no noticeable difference in cleaning performance versus a reference composition, to 4, meaning a noticeable difference in cleaning performance versus a reference composition, can be applied.

Shine Test Under Neat Conditions

The shine test is done with the black glossy ceramic tiles which are neat and cleaned with the low VOC hard surface cleaning composition. Results are analysed by using grading described below.

| Grading in absolute scale: | |
|---|---|
| 0 = | as new/no streaks and/or film |
| 1 = | very slight streaks and/or film |
| 2 = | slight streaks and/or film |
| 3 = | slight to moderate streaks and/or film |
| 4 = | moderate streaks and/or film |
| 5 = | moderate/heavy streaks and/or film |
| 6 = | heavy streaks and/or film |
| and PSU Scale: | |
| 0 = | I see no difference |
| 1 = | I think there is difference |
| 2 = | I am sure there is a slight difference |
| 3 = | I am sure there is a difference |
| 4 = | I am sure there is a big difference |

Phase Stability Test:

400 ml of product is made in a 600 ml glass beaker. The preparation is made by following the process to prepare a low VOC hard surface cleaning composition as described above at room temperature with mixing speed of 300 rpm (a mechanical mixer "IKA yellow line ost 20 digital"). Upon addition of the last ingredient, the mixture is stirred continuously at 300 rpm speed for 20 minutes. The product is poured into a glass bottle and left to rest at room temperature on the laboratory bench over night.

The phase stability is assessed visually the day after. If the product is graded as clear if it is homogenous, without any precipitation and/or haze it is considered as phase stable.

| | Ex. 1 % active | Ex. 2 % active | Ex. 3 % active | Ex. 4 % active | Ex. 5 % active | Ex. 6 % active | Ex. 7 % active | Ex. 8 % active |
|---|---|---|---|---|---|---|---|---|
| SURFACTANTS | | | | | | | | |
| Cocamidopropyl hydroxysultaine | 0.5 | | | | | | | 0.16 |
| Disodium cocoamphodipropionate | | | | | | 0.4 | 0.6 | |
| Alkyldiphenyloxide disulfonate | | | | | | 0.15 | 0.15 | |
| Secondary alkane sulfonate | | 0.12 | 0.12 | 0.12 | 0.12 | | | |
| Polymeric surfactant | | 0.1 | 0.1 | 0.5 | 0.5 | | | |
| SOLVENTS | | | | | | | | |
| Diethylene glycol monobutyl ether | 1.5 | | | | | | | |
| Ethylene glycol monohexyl ether | | 0.6 | 0.6 | 0.6 | 0.6 | 0.6 | 0.6 | |
| Isopropyl alcohol | | 0.5 | | 1 | | | 3 | |
| Propylene glycol | | 0.25 | 0.25 | 0.25 | 0.25 | 0.25 | 0.25 | |
| POLYMER | | | | | | | | |
| Acrylic copolymer | | | | | | | 0.2 | |
| Acrylamide acrylic polymer | | 0.1 | 0.1 | 0.1 | 0.1 | | | |
| BUFFER/ BUILDER | | | | | | | | |
| Monoethanolamine | 0.5 | | | | | 0.2 | 0.6 | 0.5 |
| Ammonium hydroxide | | 0.09 | 0.09 | 0.09 | 0.09 | 0.3 | 0.3 | |
| Tartaric acid | | | | | | | | 0.5 |

-continued

| | Ex. 1 % active | Ex. 2 % active | Ex. 3 % active | Ex. 4 % active | Ex. 5 % active | Ex. 6 % active | Ex. 7 % active | Ex. 8 % active |
|---|---|---|---|---|---|---|---|---|
| HYDROTROPE | | | | | | | | |
| Sodium cumene sulfonate | 0.3 | | | | | | | |
| PRESERVATIVE | | | | | | | | |
| 1,2 Benzisothiazolin-3-one | 0.01 | | | | | | | |
| BIOCIDE | | | | | | | | |
| blend of alkyl dimethyl benzyl ammonium chlorides and alkyl dimethyl ethylbenzyl ammonium chlorides | | | | | | | | 0.1 |
| FRAGRANCE | | | | | | | | |
| | 0.2 | 0.2 | 0.2 | 0.2 | 0.2 | 0.2 | 0.2 | 0.2 |
| Stability at RT | Clear | Hazy | Hazy | Hazy | Hazy | Hazy | Hazy | Hazy |
| Neat shine PSU | 0 | 3 | 3 | 3 | 3 | 3 | −1 | 0 |
| Neat cleaning CI | 100 | 22 | | 45 | | 100 | 130 | 22 |

Amphoteric surfactant cocamidopropyl hydroxysultaine is commercially available from Rhodia under the trade name Mackam 50-SB.

Amphoteric surfactant disodium cocoamphodipropionate is commercially available from Rhodia under the trade name Mackam 2CSF.

Anionic surfactant alkyldiphenyloxide disulfonate is commercially available from Dow under the trade name Dowfax C10L.

Anionic surfactant secondary alkane sulfonate is commercially available from Clariant under the tradename Hostapur SAS 30.

Polymeric surfactant is commercially available from Vitech International under the trade name Videt EGM.

Diethylene glycol monobutyl ether is a glycol ether solvent commercially available from Dow under the trade name Butyl Carbitol.

Ethylene glycol monohexyl ether is a glycol ether solvent commercially available from Dow under the trade name Hexyl Cellosolve.

Isopropyl alcohol is a secondary alcohol available from Dow.

Propylene glycol is a diol available from Dow.

Monoethanolamine is both a primary amine and alcohol commercially available from Huntsman or Dow.

Sodium cumene sulfonate is commercially available Nease.

Acrylic copolymer is commercially available from Cognis under the tradename Polyquart ampho 149.

Acrylamide acrylic polymer is commercially available from Rhodia under the trade name Mirapol Surf S-210.

1,2 Benzisothiazolin-3-one is commercially available from Rhom & Haas under the trade name Koralone B-119.

Results

Stability:

Example 1, which is composition according to present invention, formed clear phase stable composition. Comparative compositions (Examples 2-8) from the literature were generated, some of them being indicated as low VOC composition, and tested for the stability. All comparative formulae turned hazy after perfume addition. This haziness is further evolving to a phase separation at room temperature. In conclusion, only example 1 gives a clear and phase stable emulsion.

Neat Shine:

Examples 7 and 8 have similar neat shine profile than example 1. Examples 2-6 have better neat shine profile than example 1.

Neat Cleaning:

Examples 6 and 7 have equal or slightly better neat cleaning performance compared to the example 1. Examples 2, 4 and 8 all have a significantly worse neat cleaning performance than the example 1.

In summary example 1, which is according to present invention, is only phase stable composition and is able to deliver good neat cleaning performance whilst providing adequate shine performance.

EXAMPLES

The following examples will further illustrate the present invention. The compositions are made by combining the listed ingredients in the listed proportions (weight % unless otherwise specified). The following Examples are meant to exemplify compositions used in a process according to the present invention but are not necessarily used to limit or otherwise define the scope of the present invention. Examples E and F are examples of 15 fold compaction.

| | A | B | C | D | E | F |
|---|---|---|---|---|---|---|
| Non ionic | | | | | | |
| $C_{13-15}EO_{30}$ | 0.20 | | 0.25 | | 3 | 3.75 |
| Alkyl polyglycoside | 0.20 | | | | 3 | |
| $C_{9-11}EO_8$ | | 1.00 | | 0.5 | | |
| Amphoteric | | | | | | |
| Cocamidopropyl hydroxysultaine | | | 0.3 | | | 4.5 |

-continued

| | A | B | C | D | E | F |
|---|---|---|---|---|---|---|
| Solvent | | | | | | |
| Diethylene Glycol Monobutyl Ether | 1 | 1.0 | 1.5 | 1.5 | 15 | 22.5 |
| Ethylene Glycol Monohexyl Ether | | 0.5 | | | | |
| Ethylene glycol monophenyl ether | 0.5 | 0.5 | | | 7.5 | |
| Buffer | | | | | | |
| Monoethanolamine | 0.5 | 0.5 | 0.5 | 0.5 | 7.5 | 7.5 |
| Preservative | | | | | | |
| 1,2-benzisothiazolin-3-one | | | 0.01 | 0.01 | | 0.15 |
| Chelant | | | | | | |
| diethylene triamine pentaacetic acid | | 0.1 | | | | |
| Acid | | | | | | |
| Tartaric acid | 0.02 | 0.02 | | | 0.3 | |
| Biocide | | | | | | |
| Blend of alkyl dimethyl benzyl ammonium chlorides and alkyl dimethyl ethylbenzyl ammonium chlorides | 0.1 | 0.1 | | | 1.5 | |
| Fragrance | | | | | | |
| Fragrance A | 0.1 | 0.1 | 0.2 | 0.25 | 1.5 | 3 |
| Dye | | | | | | |
| Dye A | 0.002 | 0.002 | | 0.002 | 0.03 | 0.03 |
| Dye B | | | 0.003 | | | |
| Water | up to 100% | up to 100% | up to 100% | up to 100% | up to 100% | up to 100% |
| pH | 11.0 | 11.0 | 11.1 | 11.1 | 11.0 | 11.1 |

Non-ionic surfactant $C_{13-15}$ $EO_{30}$ is commercially available from BASF under the tradename Lutensol AO30.

Non-ionic surfactant alkyl polyglycoside is commercially available from Dow under the tradename Triton CG-50.

Non-ionic surfactant $C_{9-11}EO_8$ is commercially available from Shell under the tradename Neodol 91-8.

Amphoteric surfactant cocamidopropyl hydroxysultaine is commercially available from Rhodia under the tradename Mackam 50-SB.

Diethylene glycol monobutyl ether is a glycol ether solvent commercially available from Dow under the tradename Butyl Carbitol.

Ethylene glycol monohexyl ether is a glycol ether solvent commercially available from Dow under the tradename Hexyl Cellosolve.

Ethylene glycol monophenyl ether is a glycol ether solvent commercially available from Dow under the tradename Dowanol Eph.

Monoethanolamine is both a primary amine and alcohol commercially available from Huntsman or Dow.

Sodium cumene sulfonate is commercially available Nease.

1,2 Benzisothiazolin-3-one is commercially available from Rhom & Haas under the tradename Koralone B-119.

Diethylene triamine pentaacetic acid is commercially available from Dow under the tradename Versenex.

Tartaric acid is 2,3-dihydroxybutanedioic acid commercially available from American Tartaric Products.

Blend of alkyl dimethyl benzyl ammonium chlorides and alkyl dimethyl ethylbenzyl ammonium chlorides is commercially available from Lonza under the tradename Barquat 4280Z.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A low VOC hard surface cleaning composition comprising a) from about 0.30 to about 1.0% by weight of the composition of surfactant or mixtures thereof selected from the group consisting of sulfobetaines and non-ionic surfactants;

b) from about 1.25 to about 2.5% by weight of the composition of glycol ether organic solvent selected from the group consisting of butyl carbitol, hexylcellosolve and phenoxyethanol and mixtures thereof;

c) from about 0.1 to about 0.5% by weight of the composition of aminoalcohol or mixture thereof; and d) from about 0.075 to about 0.3% by weight of the composition of perfume or mixture thereof;

and wherein said composition has pH from about 10.0 to about 12.0 and said non-ionic surfactant is $C_{13-15}$ $EO_{30}$ ethoxylated alcohol.

2. A low VOC hard surface cleaning composition according to claim 1, having pH from about 10.9 to about 11.1.

3. A low VOC hard surface cleaning composition according to claim 1, wherein said sulfobetaine is cocamidopropyl hydroxysultaine.

4. A low VOC hard surface cleaning composition according to claim 1 comprising from about 0.35 to about 0.5% by weight of composition of said surfactant.

5. A low VOC hard surface composition according to claim 1 further comprising from about 0.01 to about 0.15% by weight of the composition of an antibacterial agent.

6. A low VOC hard surface cleaning composition according to claim 1 comprising from about 1.5 to about 2.0% by weight of composition of said glycol ether organic solvent.

7. A low VOC hard surface cleaning composition according to claim 1, wherein said aminoalcohol is selected from the group consisting of monoethanol amine, monoisopropanol amine and mixtures thereof.

8. A low VOC hard surface cleaning composition according to claim 1, wherein said aminoalcohol is monoethanol amine.

9. A low VOC hard surface cleaning composition according to claim 1 comprising from about 0.25 to about 0.5% by weight of composition of said aminoalcohol.

10. A low VOC hard surface cleaning composition according to claim 1 comprising about 0.5% by weight of composition of said aminoalcohol.

11. A low VOC hard surface cleaning composition according to claim 1, wherein said perfume comprises one or more perfume ingredients.

12. A low VOC hard surface cleaning composition according to claim 1 comprising from about 0.08 to about 0.27% by weight of composition of said perfume.

13. A low VOC hard surface cleaning composition according to claim 1 comprising from about 0.1 to about 0.25% by weight of composition of said perfume.

14. A low VOC hard surface cleaning composition according to claim 1, in 15 fold compaction.

15. Process of preparing low VOC hard surface cleaning composition according to claim 1 comprising steps of:

i) Preparing a perfume premix by adding a perfume, a solvent and a surfactant together and stirring;

ii) Preparing an aqueous premix by adding remaining ingredients into water and stirring;

iii) Adding the perfume premix from the step i) into the aqueous premix from the step ii) and stirring.

16. A process of cleaning a surface with a low VOC hard surface cleaning composition according claim 1, wherein said surface is contacted with said composition, wherein said composition is applied onto said surface.

* * * * *